US006119430A

United States Patent [19]

Nicholls

[11] Patent Number: 6,119,430

[45] Date of Patent: Sep. 19, 2000

[54] METHOD AND APPARATUS FOR AN ADJUSTABLE BUILDING STUD

[76] Inventor: J. Robert Nicholls, 400 E. Selah Rd., Yakima, Wash. 98901

[21] Appl. No.: 09/161,177

[22] Filed: Sep. 25, 1998

[51] Int. Cl.[7] ..... E04C 3/30

[52] U.S. Cl. ..... 52/733.2; 52/118; 52/243.1; 52/731.9; 52/733.3; 52/741.1

[58] Field of Search ..... 52/118, 111, 243.1, 52/481.1, 645, 731.1, 731.9, 733.2, 733.3, DIG. 3, 741.1

[56] References Cited

U.S. PATENT DOCUMENTS

| | | | |
|---|---|---|---|
| 3,204,382 | 9/1965 | McGurn | 52/645 X |
| 3,222,095 | 12/1965 | Gerus | 403/104 |
| 3,243,930 | 4/1966 | Slowinski . | |
| 3,492,766 | 2/1970 | Andrews . | |
| 3,685,863 | 8/1972 | Oetiker . | |
| 3,844,085 | 10/1974 | Marchello . | |
| 3,897,668 | 8/1975 | McDonnell | 52/632 |
| 4,112,638 | 9/1978 | Hanson, Sr. | 52/169.12 |
| 4,227,360 | 10/1980 | Balinski . | |
| 5,040,345 | 8/1991 | Gilmour | 52/243.1 |
| 5,079,884 | 1/1992 | Menchetti | 52/243.1 X |
| 5,381,635 | 1/1995 | Sanger | 52/251 |
| 5,497,591 | 3/1996 | Nelson . | |
| 5,596,859 | 1/1997 | Horton et al. | 52/731.9 X |
| 5,685,121 | 11/1997 | DeFrancesco et al. | 52/731.9 |
| 5,735,100 | 4/1998 | Campbell | 52/645 |
| 5,803,652 | 9/1998 | Zuffetti | 52/645 X |

FOREIGN PATENT DOCUMENTS

| | | | |
|---|---|---|---|
| 2855604 | 4/1980 | Germany | 52/731.9 |

*Primary Examiner*—Beth A. Stephan
*Assistant Examiner*—Brian E. Glessner
*Attorney, Agent, or Firm*—Stratton Ballew PLLC

[57] ABSTRACT

A building stud having a slidable insert that provides the stud with an adjustable length. The stud includes an runner and a sleeve. The runner slides into the sleeve to form a stud having an adjustable length. Tabs can be utilized to nail the stud to a structure, or a frame member. The tabs can also be modified to allow the attachment of the stud to a segment of rebar, or set directly into an earthen grade or a concrete material. A siding material can be directly attached to the stud. The stud is especially useful as a framing member for skirting of manufactured homes. The stud is preferably manufactured from a heavy gauge of aluminum or alternatively from a galvanized sheet metal. The stud can include a staked end for insertion directly into soil surfaces or wet concrete. The stud can be installed on a heaving surface to provide a self adjusting siding system that does not buckle or gap, with small changes in the surface upon which it is mounted.

9 Claims, 3 Drawing Sheets

METHOD AND APPARATUS FOR AN ADJUSTABLE BUILDING STUD

TECHNICAL FIELD

The invention relates to an adjustable building stud method apparatus, and more particularly to a stud having a slidable extension that provides the stud with an adjustable length.

BACKGROUND OF THE INVENTION

The building stud has evolved from simple wood supports to alternative designs that better accommodate modem building construction needs and requirements. Because the cost of wood products continues to rise, building studs fabricated from metal materials are more often substituted for wood studs. In response to fire safety, health and sanitation concerns, metal studs are favored over wood materials, because the metals used for studs are non-flammable and do not harbor insects or bacteria. Additionally, improvements in metal stud design, made with the objective of rendering the modified stud superior to wood studs in specific uses and applications, are numerous and the objects of several U.S. patents. As an example, U.S. Pat. No. 3,243,930 to Slowinski shows a standard metal stud having a corrugated length that facilitates screw penetrations into the stud and provides additional structural strength.

A problem with a standard metal stud, such as disclosed in Slowinski '930 is that the length of the metal stud is difficult to modify in the field or on the construction site. Even with the proper saws and tools to shorten the length of a standard metal stud, these studs are not extendable. Furthermore, the act of shortening a metal stud requires some time and potentially a dangerous cutting operation, especially when performed by an unskilled worker.

To provide a field adjustable metal stud, U.S. Pat. No. 3,492,766 to Andrews discloses an adjustable metal stud having an adaptor that slides into the end of the stud. However, the Andrews '766 stud is only adjustable for short variations in length. Additionally, a tab in the adaptor must be folded back and attached to the stud. The length of the extension is limited by the webbed tab of the extending member. An adjustable stud is needed that can better and more easily extend to span a wider range of distances, and without a webbed tab to hold and strengthen the stud's length.

U.S. Pat. No. 5,596,859 to Horton discloses a two part "telescoping" metal wall stud that additionally includes metal tabs at each end for attachment to structural plates. Horton '859 requires that two identical studs of substantially conventional design be nested together for the telescoping embodiment. This nested arrangement requires twice the material and expense of a typical non-telescoping stud, to form a single telescoping stud. A telescoping stud is needed that does not require twice the material and expense of a nested metal stud arrangement.

SUMMARY OF INVENTION

The present invention provides a building stud having a slidable insert that provides the stud with an adjustable length. The stud includes an runner and a sleeve. The runner slides into the sleeve to form a stud having an adjustable length. The sleeve of the stud includes a sleeve terminal end, the sleeve terminal end having a sleeve tab. The runner of the stud includes an runner terminal end, the runner terminal end having a runner tab. The tabs can be utilized to nail the stud to a structure, or a frame member. The tabs can also be modified to allow the attachment of the stud to a segment of "rebar," or set directly into an earthen grade or a concrete material.

Additionally, a siding material can be directly attached to the stud. The stud is especially useful as a framing member for skirting of manufactured homes, in which the stud is employed to vertically span a space between the grade and an outer perimeter of the home. The siding material, or a base trim, can then be attached along the length of the sleeve and the runner of the stud.

The stud performs well as a lateral support for siding or trim or earth, attached along the length of the stud or piled along the length of the stud. The stud is preferably manufactured from a galvanized sheet metal or alternatively from aluminum. Also alternatively, the stud can be manufactured from a fibrous material, such as a fiber glass, or a plastic material, such as a PVC. The stud is ideally suited for modular or prefabricated homes that supports for require base trim to be attached to the perimeter of the home, as the home is fully supported from interior foundational supports, but requires a base trim around its perimeter.

In another preferred embodiment of the invention, the stud can include a staked end for insertion directly into soil surfaces or wet concrete.

In yet another preferred embodiment of the invention, the stud can be installed on a heaving surface to provide a self adjusting siding system that does not buckle or gap, with small changes in the surface upon which it is mounted.

According to one advantage of the invention, the length of the stud is easily modified in the field or on the construction site, without the use of tools.

According to another advantage of the invention, the stud better and more easily extends to span a wider range of distances, compared to other adjustable studs.

DETAILED DESCRIPTION OF SPECIFIC EMBODIMENTS

The invention provides a building stud having a slidable extension that provides the stud with an adjustable length. Preferred embodiments of the stud 11 are shown in FIGS. I through 10. As detailed in FIGS. 1, 2 and 3, the stud includes an runner 15 and a sleeve 20. The runner slides into the sleeve to form the stud.

Figure 4:
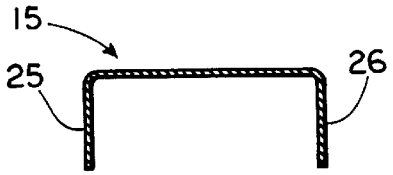
FIG. 4 is a sectional view of the adjustable building stud, taken along section line 4—4 of FIG. 3, according to another embodiment of this invention.
Figure 5:
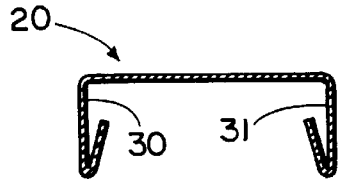
FIG. 5 is a sectional view of the adjustable building stud, taken along section line 5—5 of FIG. 2, according to an embodiment of this invention.

The runner 15 of the stud 11 has an runner width. The runner width is defined by the distance between a first runner edge 25 and a second runner edge 26, as detailed in FIG. 4. The sleeve has a sleeve width that is greater than the runner width. The sleeve width is defined as the distance between a first sleeve edge 30 and a second sleeve edge 31, as detailed in FIG. 5.

Figure 9:
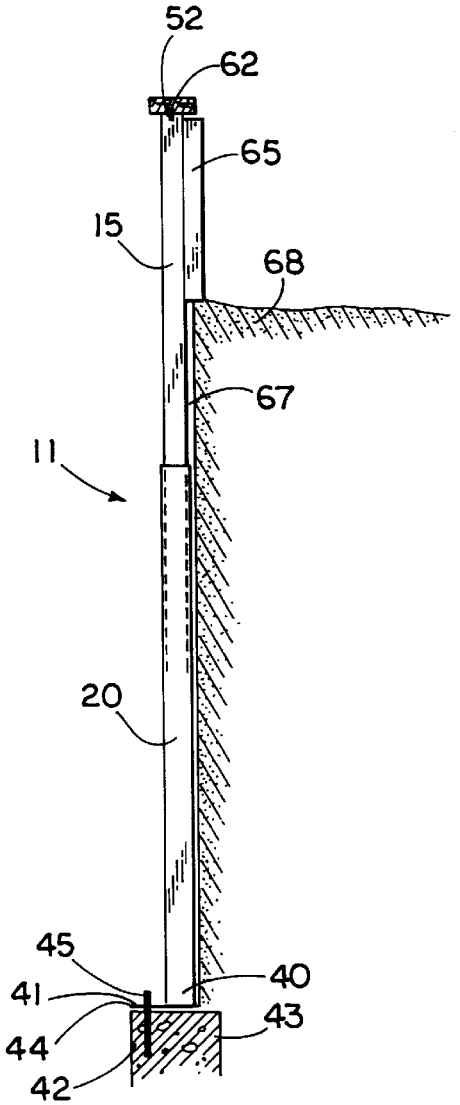
FIG. 9 is an elevational view of the adjustable building stud, according to an embodiment of this invention.
Figure 10:
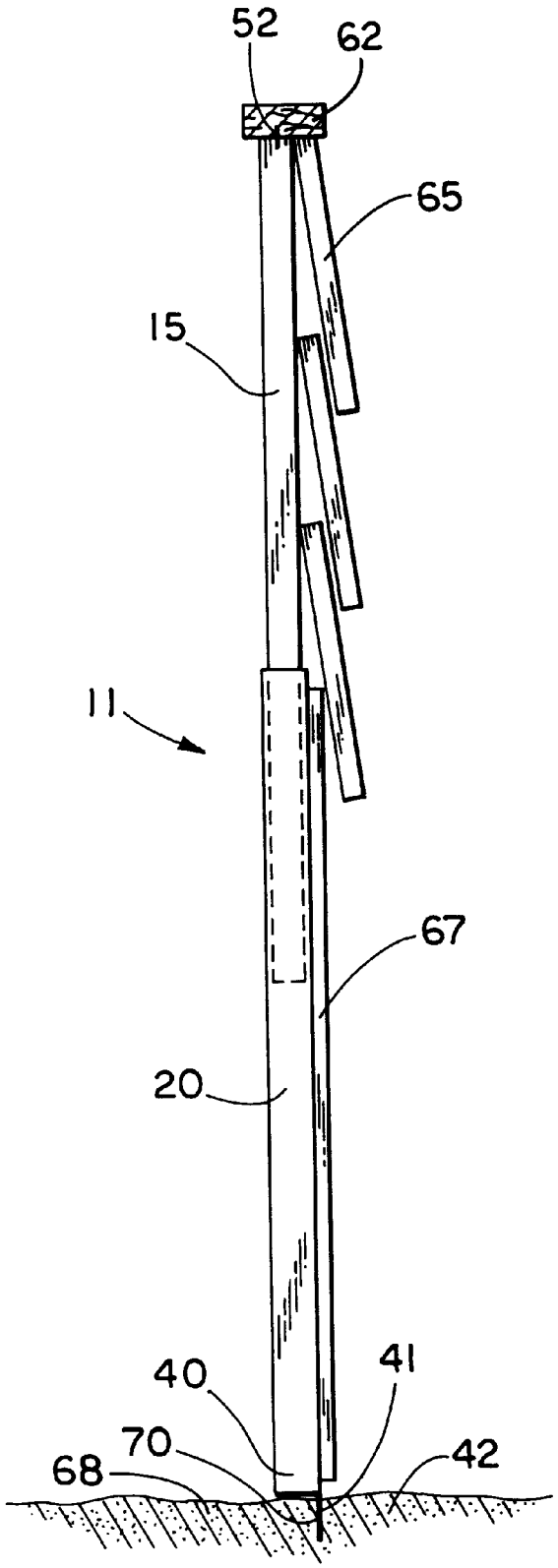
FIG. 10 is an elevational view of the adjustable building stud, according to another embodiment of this invention.

The runner 15 of the stud 11 is slidably receivable into the sleeve 20 to provide the stud with an adjustable length. FIGS. 9 and 10 show that the length of the stud is adjustable to span the height of a desired opening.

Figure 1:
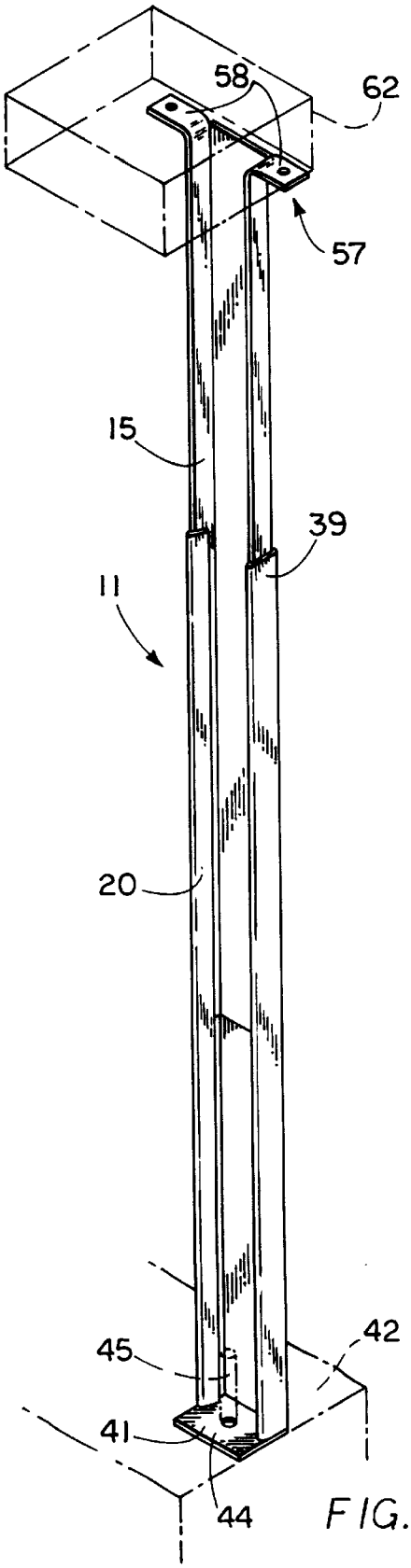
FIG. 1 is a perspective diagram of an adjustable building stud, according to an embodiment of this invention.
Figure 2:
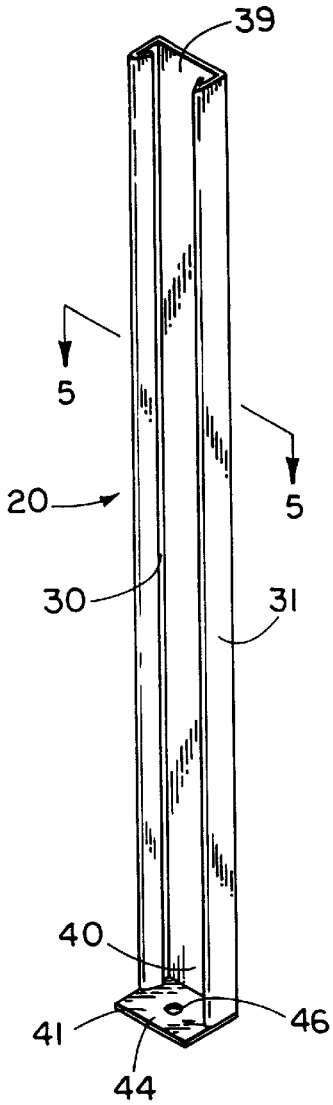
FIG. 2 is a perspective diagram of a portion of the adjustable building stud, according to an embodiment of this invention.

As further detailed in FIG. 2, the sleeve 20 of the stud 11 includes a receiver end 39 and a sleeve terminal end 40. The receiver end of the stud receives the runner. The sleeve terminal end preferably includes a sleeve tab 41. The sleeve tab is preferably utilized to anchor the stud to a base 42. This base can be a variety of structures or materials. As shown in FIG. 9, the base can be a concrete curb 43, which could be a top wall of a foundation, a masonry wall or a poured concrete pad. For a concrete curb, the sleeve tab can be a rebar tab 44, embodied as shown in FIGS. 1 and 9, to receive a segment of "rebar" 45. The rebar, or reenforcing bar, can be set into an earthen grade or a concrete material. Rebar is conunonly utilized for reenforcing concrete structures, and is essentially a bendable segment of a substantially cylindrical metal stock, typically having a small diameter. Bolts can also be utilized as an alternative to rebar segments.

For an attachment of the stud 11 to the concrete curb 43, a rebar sized penetration 46, through the rebar tab 44 can be utilized, as shown in FIG. 2. The rebar sized penetration in the rebar tab can receive the rebar 44 and so the stud is prevented from moving in a lateral direction on the concrete curb or foundation wall. Alternatively, a cap piece (not shown) can be installed on the rebar to prevent the stud form vertical motion on the rebar, however the cap is not normally required. Also alternately, the rebar can be placed directly into a base 42 that comprises an earthen grade, leaving a short segment of the rebar exposed. The rebar sized penetration of the rebar tab can then receive the segment of rebar.

Figure 7:
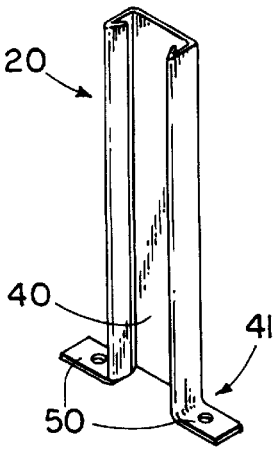
FIG. 7 is a perspective diagram of a portion of the adjustable building stud, according to another embodiment of this invention.

As an alternative sleeve tab 41, the sleeve terminal end 40 of the stud 11 can include a pair of sleeve nailer tabs 50, as shown in FIG. 7. A typical wooden sill plate (not shown), attached to a foundation wall are common examples of bases 42 that the stud of the present invention could be anchored upon, utilizing the sleeve nailer tabs. If the base is a nailable structure, the pair of sleeve nailer tabs are preferred for anchoring the sleeve 20. A nailable structure can include as a sill plate comprising of a wood material, or sill can be a metal material, such as a metal stud of conventional design. A pair of nails, or screws can be utilized to attach the sleeve nailer tab to the sill plate.

Figure 3:
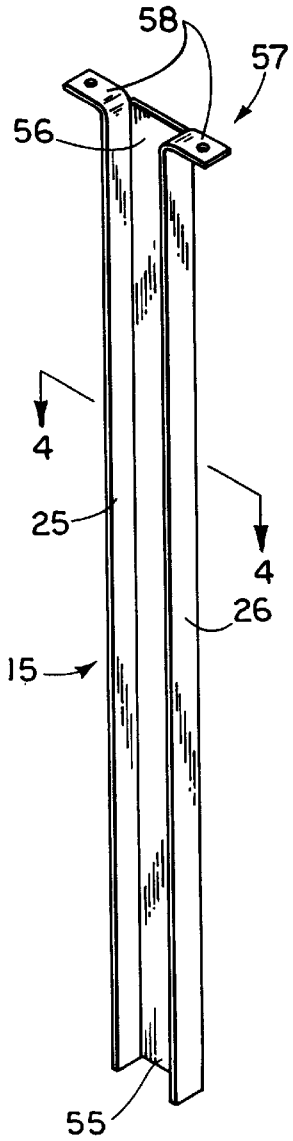
FIG. 3 is a perspective diagram of a portion of the adjustable building stud, according to an embodiment of this invention.
Figure 6:
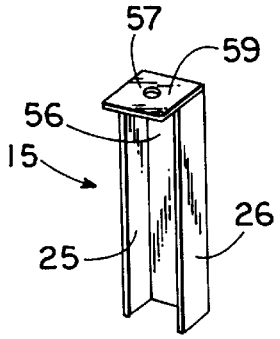
FIG. 6 is a perspective diagram of a portion of the adjustable building stud, according to another embodiment of this invention.

The runner 15 is preferably configured as shown in FIG. 3. Configured similarly to the sleeve 20, the runner includes an insert end 55, a runner terminal end 56, and a runner tab 57 at the runner terminal end. Preferably, the runner tab comprises a pair of runner nailer tabs 58. A pair of nails 52, as shown in FIGS. 9 and 10, or screws can be utilized to attach the runner nailer tab to a sill 62. As an alternative to the nail or screw attachment of the runner tab, a runner rebar tab 59, as shown in FIG. 6, performs adequately, especially for rebar or bolted sill attachments.

The stud 11 of the present invention is well suited for use as a framing member to support skirting around a base perimeter of a manufactured, mobile or prefabricated home or a trailer. As shown in FIG. 9, the stud can be employed to vertically span a space between the concrete curb 43, or foundation wall and the sill 62. The sill is typically positioned on an outer perimeter of the home or trailer. The stud is not intended to be employed for structural support from top to bottom, but instead utilized as a lateral support for siding or trim, attached along the length of the stud, and additionally to support the weight of dirt piled up against the attached siding or trim. After the stud has been inserted into an installation position, such as shown in FIGS. 1, 9 and 10, the stud can be adjusted without tools or a bending of tabs. The attachment of the sleeve tab 41 to the base and the runner tab 57 to the sill is all that is required to secure the stud. The stud continues to be adjustable after it has been inserted into the installation position because the stud is not intended to support weight from the sill, but supports lateral weight from along the length of the stud.

To complete the installation, a siding material 65 can be directly attached to the stud 11. In a pit installation of the stud, as detailed in FIG. 9, a rigid barrier sheet 67 can be attached to the stud and the earth piled up or back filled against the stud supported barrier sheet. The remainder of the stud can then receive a siding material, such as a corrugated fiberglass or lap siding. The siding material, or a base trim, can then be attached along the length of the sleeve 20 and the runner 15 of the stud.

Figure 8:
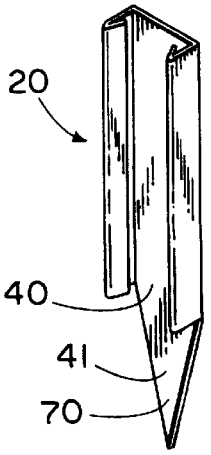
FIG. 8 is a perspective diagram of a portion of the adjustable building stud, according to another embodiment of this invention.

As shown in FIGS. 8 and 10, the sleeve tab 41 on the sleeve terminal end 40 can be modified to allow the setting of the stud 11 directly into a base, such as an earthen grade 68 or a concrete material, without the use of rebar or some similar connector. The sleeve tab can be modified to include a pointed tip 70, which can then be inserted into the earthen grade or a wet concrete material. The wet concrete material can then set, to permanently affix to the sleeve tab. The sleeve tab with the pointed end can also be driven into the earthen grade to anchor the sleeve 20.

As also shown in FIG. 10, the stud 11 can be installed to react to changes in the earthen grade 68. The stud can continue to adjust to small heaves in the earthen grade, as often occurs in frozen soils and tundra. The sleeve 20 can rise or fall to the changing surface elevation, while the runner 15 is permanently affixed to the sill 62. The siding 65, attached to the runner, overlaps the barrier sheet 67 attached to the sleeve. The result is a skirting system that responds to frost heaves without buckling or gaping.

The stud 11 is preferably manufactured from a heavy gauge of aluminum or alternatively from a galvanized sheet metal. Galvanized sheet steel of approximately 26 gage in thickness (0.0217 inches), is preferred. Alternatively, the stud can be manufactured from a fibrous material, such as a fiber glass, or a plastic material, such as a PVC.

A method of the present invention includes slidably inserting the runner 15 into the sleeve 20, forming the stud. The sleeve tab 41, of the sleeve, is then be attached to the base 42 and the runner tab 57, of the runner, attached to the sill 62.

As previously discussed, the base 42 can be any foundational curb 43, support or earthen grade 68, and the sill 62 can be any top plate or framing member, as can be typically found at the perimeter of a manufactured home or trailer. The stud thereby forms a lengthwise separation of the sill from the base. This lengthwise separation is a distance that can vary from stud to stud in a particular installation and can also vary over time. Frost heaves, settling structure or changes in temperature can cause the distance to change. After attaching the sleeve tab to a base and attaching the runner tab to a sill, the length ofthe stud can instantaneously and by itself adjust to accommodate changes in the distance that the base is separated from the sill.

Adjusting the length of the stud 11 is performed without tools and does not require a manual operation. The stud extends or retracts as required by the distance between the base 42 and the sill 62, respectively increasing or decreasing in length to compensate.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the following claims, as appropriately interpreted in accordance with the doctrine of equivalents.

What is claimed is:

1. An adjustable stud and skirting system comprising:

a sleeve, the sleeve having a sleeve width, and the sleeve including a sleeve terminal end, the sleeve terminal end having a sleeve tab, and the sleeve tab attachable to a base; and a runner, the runner having a runner width, and the runner including a runner terminal end, the runner terminal end having a runner tab, and the runner tab attachable to a sill, and the sleeve width is greater than the runner width, the runner slidably receivable into the sleeve to form a stud;

a barrier sheet attachable to the sleeve; and a siding attachable to the runner, the siding for overlapping the barrier sheet and the barrier sheet slidable beneath the siding as the sleeve slides on the runner.

2. The adjustable stud of claim 1, wherein the stud is manufactured from a metal material.

3. The adjustable stud of claim 1, wherein the stud is manufactured from a fibrous material.

4. The adjustable stud of claim 1, wherein the stud is manufactured from a plastic material.

5. The adjustable stud of claim 1, wherein the sleeve of the stud includes a sleeve terminal end, the sleeve terminal end having a sleeve tab, the sleeve tab including a pointed tip for insertion into a base.

6. The adjustable stud and skirting system of claim 1, wherein the barrier sheet is a rigid barrier sheet.

7. The adjustable stud and skirting system of claim 1, wherein the base is an earthen grade.

8. A method of an adjustable stud skirting system comprising the steps of:

a) slidably inserting a runner into a sleeve, the runner having a runner width, and the runner including a runner terminal end, the runner terminal end having a runner tab, and the sleeve having a sleeve width, the sleeve including a sleeve terminal end, the sleeve terminal end having a sleeve tab, and the sleeve width is greater than the runner width;

b) forming a stud having a length;

c) attaching the sleeve tab to a base;

d) attaching the runner tab to a sill, the sill separated from the base by a distance;

e) attaching a barrier sheet to the sleeve;

f) attaching a siding to the runner;

g) overlapping the barrier sheet with the siding; and h) instantaneously and self adjusting the length of the stud to accommodate changes in the distance that the base is separated from the sill.

9. The adjustable stud skirting system method of claim 8 including the additional step of:

i) sliding the barrier sheet beneath the siding.

* * * * *